United States Patent [19]

Duncan et al.

[11] 4,059,204

[45] Nov. 22, 1977

[54] SYSTEM FOR DISPENSING AND CONTROLLING THE TEMPERATURE OF HOT MELT ADHESIVE

[75] Inventors: Robert John Duncan, Magnolia; Richard Montgomery Elliott, Beverly, both of Mass.

[73] Assignee: USM Corporation, Boston, Mass.

[21] Appl. No.: 735,191

[22] Filed: Oct. 26, 1976

[51] Int. Cl.[2] ..... B67D 5/62

[52] U.S. Cl. ..... 222/146 HE; 219/241; 219/499

[58] Field of Search ..... 222/54, 146 HE; 219/230, 241, 421, 422, 425, 499; 228/52, 53

[56] References Cited

U.S. PATENT DOCUMENTS

| | | | |
|---|---|---|---|
| 3,946,200 | 3/1976 | Juodikis | 219/499 |
| 3,964,644 | 6/1976 | Wallace | 222/146 HE |

*Primary Examiner*—Stanley H. Tollberg
*Assistant Examiner*—Hadd S. Lane
*Attorney, Agent, or Firm*—Carl E. Johnson; Richard B. Megley; Vincent A. White

[57] ABSTRACT

In a hot melt adhesive dispensing gun, an electronic circuit is constructed to enable the operator to set a desired temperature to which the glue is heated. This set point is automatically raised a predetermined amount when the glue is flowing in order to compensate for the drop in temperature caused by the loss of heat to the glue and atmosphere.

8 Claims, 4 Drawing Figures

SYSTEM FOR DISPENSING AND CONTROLLING THE TEMPERATURE OF HOT MELT ADHESIVE

BACKGROUND OF THE INVENTION

This invention relates to apparatus for melting and dispensing thermoplastic materials such as hot melt adhesives. This type of thermoplastic material is received in the form of an elongated, flexible rod, as disclosed, for example, in U.S. Pat. No. 2,874,084, issued Feb. 17, 1959, in the name of Hans C. Paulsen. The invention disclosed may be utilized in portable hand-operated cement extruding guns such as used for home shop use or light industrial use and disclosed, for instance, in U.S. Pat. No. 3,743,142, issued July 3, 1973, in the names of Richard M. Elliott and Albert E. Newton. The invention may also be adapted to heavier industrial usage, for example, in applying adhesives in the manufacture of shoes or in the production of package containers.

In general, the glue dispensing appliance in which the subject system is used consists of a gun shaped device having a handle and a barrel. A heat radiating body (melt body) is constructed within the barrel to transfer heat from electric heaters to a melt chamber. Means are provided in the handle to feed a flexible rod of heat activatable glue to the melt chamber. As the glue is melted it is forced out of a nozzle at the exit of the melt chamber. A thermostat or other heat sensing device is used to prevent overheating and maintain the desired heat temperature of the melt chamber.

In the normal operation of this type of appliance, the heaters are energized and allowed to reach operating temperature. The flow of glue is generally initiated intermittently as needed without shutting the power off between uses. The glue gun may, ther1fore, sit idle for extended periods while the desired temperature is maintained by a suitable sensor-control. However, when the glue feed is actuated, an immediate demand for more heat occurs because of the relatively low temperature of the incoming glue. The normal control senses the temperature of the melt body, not the temperature of the glue, in the melt chamber. This causes a delay in response and a resultant drop in output glue temperature.

Even with optimum heat transfer characteristics, the melt chamber will not be able to heat the flowing glue to its identical temperature and it has been found in this case that while glue is flowing, there will be approximately a 60° differential between the temperatures of the melt chamber and the output glue. A quick way to compensate for this heat loss would be to raise the temperature of the melt body 60° beyond the desired glue temperature. However, this would overheat the residual glue left in the chamber during the idle condition and cause a loss in bonding strength.

It is therefore the object of this invention to provide a control system for the melt body temperature which maintains the glue as close as possible to the temperature of the melt body without causing the temperature of the glue to exceed the desired output temperature.

SUMMARY OF THE INVENTION

A system is constructed to provide a dual set point for the temperature control of the heat applied to the melt body of a hot melt glue dispensing gun. The circuit is connected to control the current supplied to the electric heating elements through a gate which may be actuated by pulses from an integrated circuit. The integrated circuit contains an operational amplifier whose bias circuit includes a thermistor the resistance of which varies with the temperature of the melt body. A variable resistor also forms part of this bias circuit in order to provide an adjustable set point for the temperature at which the heater gate will be opened, thereby disconnecting the heater. The integrated circuit has an internal reference voltage which will cause the amplifier to send signals to the heater gate until the voltage drop across the thermistor is less than the reference voltage. The heaters will then be shut off. The reference voltage is connected to common across a resistor of predetermined value through a transistor. The transistor is connected to conduct upon initiation of low temperature glue into the melt chamber. This will have the effect of dropping the reference voltage and raising the temperature control set point to provide a surge of heat to compensate for the drop in glue temperature during the influx of glue to the melt chamber.

DESCRIPTION OF THE DRAWING

The subject invention is described in more detail below with reference to the attached drawing and in said drawing.

DESCRIPTION OF THE PREFERRED EMBODIMENT

Figure 1:
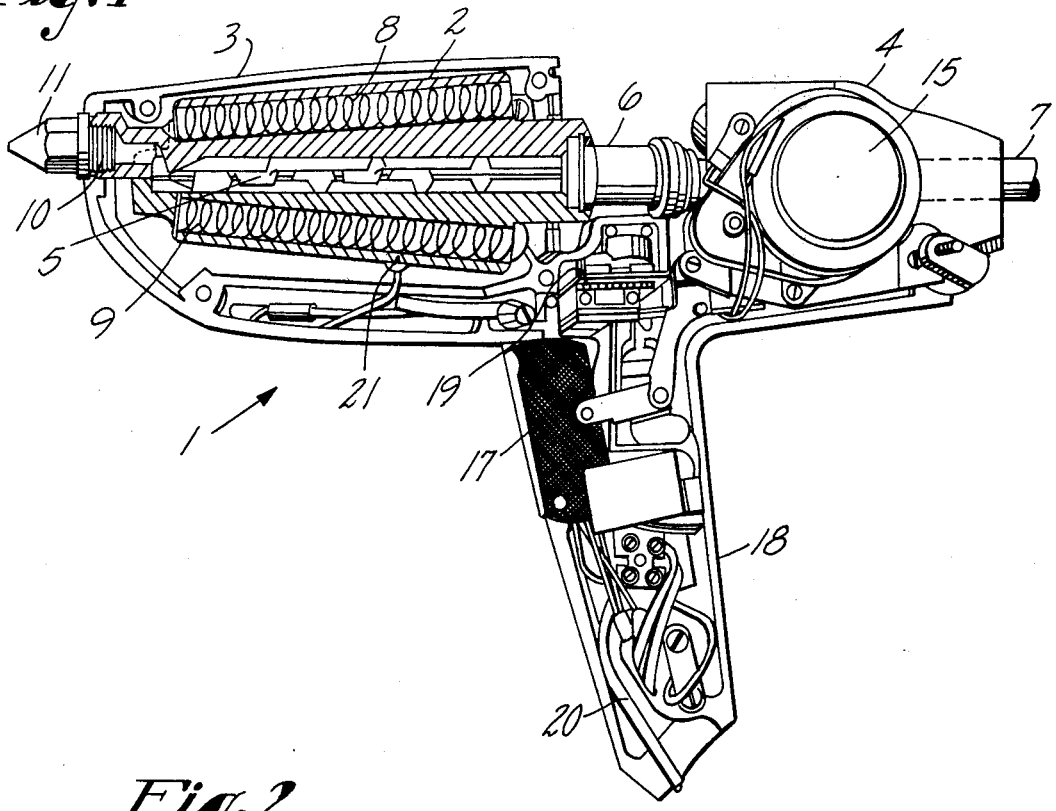
FIG. 1 is a plan view in partial section of the interior of a glue gun in which the invention may be used.

A glue gun of the type in which the subject invention is used is shown in FIG. 1. The glue gun appliance 1 consists of a melt body 2 mounted in the barrel 3 of housing 4. The melt body 2 is constructed with an inner melt chamber 5 and may be of the type described in Application for U.S. Ser. No. 676,220, filed Apr. 12, 1976, in the name of Richard M. Elliott and Albert E. Newton. The melt chamber 5 has an inlet 6 which provides a passage for the flexible glue rod 7. Heat is supplied from heaters 8 and 9 to the melt body 2 which radiates the heat through the melt chamber 5. An outlet 10 is constructed in the melt chamber 5 and interconnects with nozzle 11 to form an exit passage for the melted glue. A ball valve (not shown) is constructed to nozzle 11 to prohibit the exit of glue until a predetermined pressure is present in the melt chamber 5. This is to prevent leakage of residual glue during the idling cycle of operation.

Figure 2:
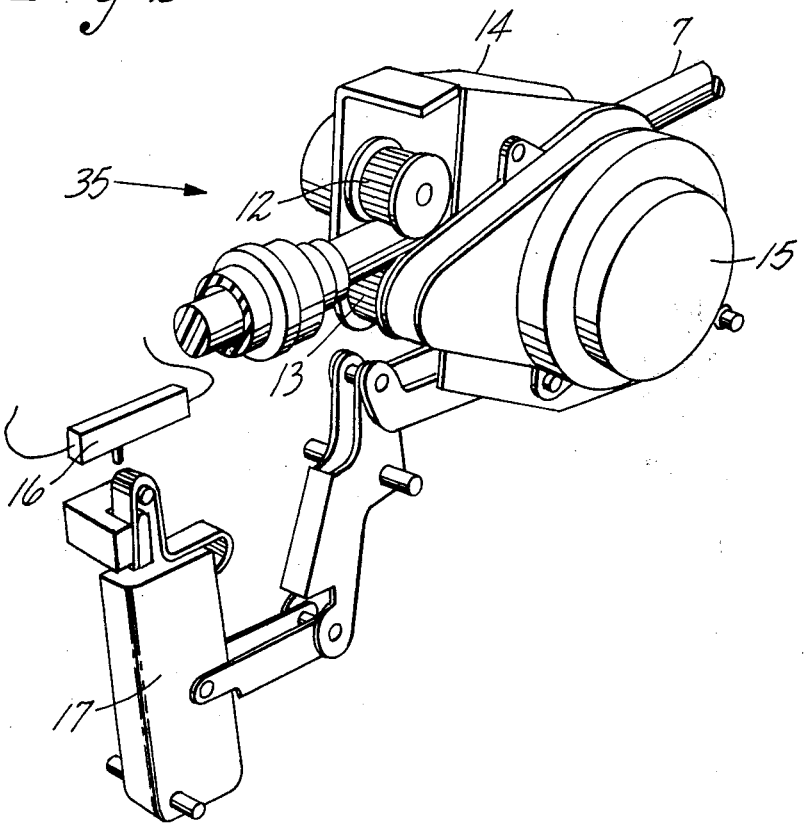
FIG. 2 is a perspective view of the feed mechanism.

The feed mechanism 35 may be of the type described in co-pending U.S. patent application Ser. No. 737,565 filed Nov. 1, 1976, in the name of Richard M. Elliott et al. As illustrated in FIG. 2, the glue rod 7 is fed into the melt chamber 5 by feed gears 12 and 13 which are driven by motors 13 and 14 respectively. The feed motors 14 and 15 are turned on by a switch 16 which is mechanically actuated by trigger 17 in the handle 18 of housing 4.

Heaters 8 and 9 are connected to a power supply through control circuit 19 and cord 20 so that the heater circuit is energized whenever the appliance 1 is plugged into a power source. The temperature of the melt body is sensed by a thermistor 21 which is embedded in the melt body 2.

The control circuit 19 is shown in FIG. 2 and connects feed motors 14 and 15 across power supply 22 through switch 16. Switch 16 is normally in the open position as shown in FIG. 2 and is only closed when the flow of glue is desired upon manual actuation of trigger 17.

Figure 3:
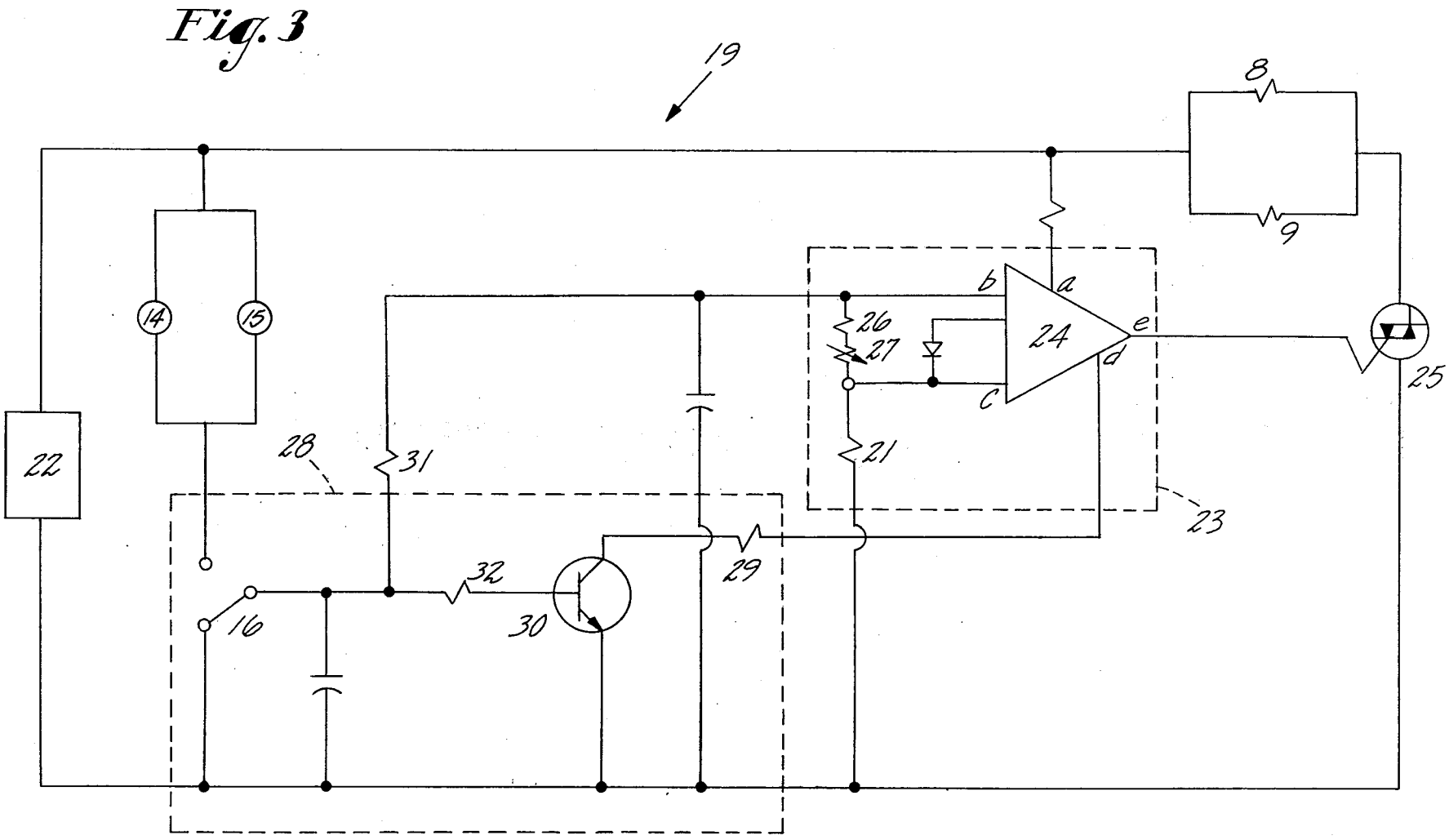
FIG. 3 is a circuit diagram of a control system of this invention.

The primary or idle temperature control circuit 23 consists of an integrated circuit 24 connected as shown in FIG. 3. Integrated circuit 24 sends pulses to gate 25 which controls the current flow to heaters 8 and 9. The gate 25 will conduct as long as it receives pulses, thereby maintaining the heaters energized.

Integrated circuit 24 converts the A-C voltage at pin A to a D-C bias voltage of approximately 6 volts at pin B. This voltage is the bias potential for an operational amplifier contained within circuit 24. The bias circuit of the amplifier consists of a fixed resistor 26, a variable resistance 27 and a thermistor 21 connected from pin B to common. The voltage present across thermistor 21 is compared to pin C to an internal reference voltage at pin D which is normally maintained at approximately 3 volts. Integrated circuit 24 will generate pulses to gate 25 until the voltage at pin C is more negative relative to the reference voltage at pin D. Since the resistance of thermistor 21 decreases as the temperature of the melt body increases the voltage at pin C will gradually be reduced until the desired temperature is reached. At this time, the pulses will cease thereby opening gate 25 and disconnecting heaters 8 and 9. The melt body 2 will then cool until the resistance of thermistor 21 increases sufficiently to trigger the pulses to gate 25. The internal reference voltage may be set to half of the bias voltage. The turn off point will therefore be reached when the thermistor resistance equals the combined resistance of resistors 26 and 27. The temperature at which the gate 25 will be opened may accordingly be adjusted by varying the resistance 27. Because of the lag of thermal response between the heaters 8 and 9 and the melt body 2, the temperature of the melt body will oscillate as the idle control circuit 23 cycles. The control cycle is therefore adjusted to obtain a desired average melt body temperature.

Another means of adjusting the temperature at which the gate will be opened is to vary the reference voltage at pin D. For this purpose, a secondary or compensating control circuit 28 is connected through resistance 29 to the collector of transistor 30. The emitter of transistor 30 is connected to common. The base of transistor 30 is connected through biasing resistors 31 and 32 to the bias potential at pin B of the integrated circuit 24. In its normal position microswitch 16 effectively shunts out the bias circuit connected to the base of transistor 30, thereby preventing transistor 30 from conducting. When the trigger is actuated, transistor 30 conducts, effectively reducing the internal reference voltage at pin D a predetermined amount depending on the resistance of resistor 29. This will have the effect of increasing the temperature set point at which the heaters 8 and 9 will be disconnected and providing a surge of additional heat as fresh glue enters the melt chamber 5.

In operation the appliance 1 is plugged in to energize the heaters 8 and 9. The heaters will gradually increase the temperature of the melt body until the desired temperature is obtained. The idle control circuit 23 will cycle off and on to maintain the average melt body temperature at the desired level. Assuming that the melt chamber 5 is filled with glue, the glue will gradually approach the temperature of the melt body 2. At this point, trigger 17 may be pulled to actuate the feed mechanism and force relatively cold glue in to the melt chamber 5, the output temperature of the glue will follow curve 33 of FIG. 4, if no additional heat is supplied. Under these circumstances, an equilibrium will be obtained during glue flow with the glue at a temperature approximately 60° below the temperature of the melt body 2. If the curve 33 were to be shifted to obtain the desired glue temperature of 375° F by boosting the average melt body temperature a continuous 35° F, a serious overheating problem would result as shown by curve 34.

In order to prevent this problem, the compensating control circuit 28 is energized by the actuation of trigger 17. The closing of microswitch 16 will energize the feed mechanism 35 and allow transistor 30 to conduct. The internal reference voltage at pin D will drop causing the heaters 8 and 9 to be energized for a longer time period. The average melt body temperature will then increase to a higher level as shown at curve 36. Because of the lag in thermal response of the melt body and the flowing glue, there is no instantaneous jump in glue temperature and it will gradually respond as shown by curve 37. The control circuit 19 whose characteristics are illustrated in FIG. 4 is constructed to give an approximate compensation of 35° F. the parameters of this circuit in this instance are as follows:

Resistor 27 — 7,500 ohm potentiometer
Resistor 26 — 2,200 ohms
Thermistor 21 — Fenwal Electric Model PP61D
Resistor 31 — 27,000 ohms
Resistor 32 — 27,000 ohms
Resistor 29 — 27,000 ohms
Transistor 30 — Motorola 2N3904
Gate 25 — Triac - RCA - Model T2806B
Integrated Circuit 24 — RCA - 3079

Figure 4:
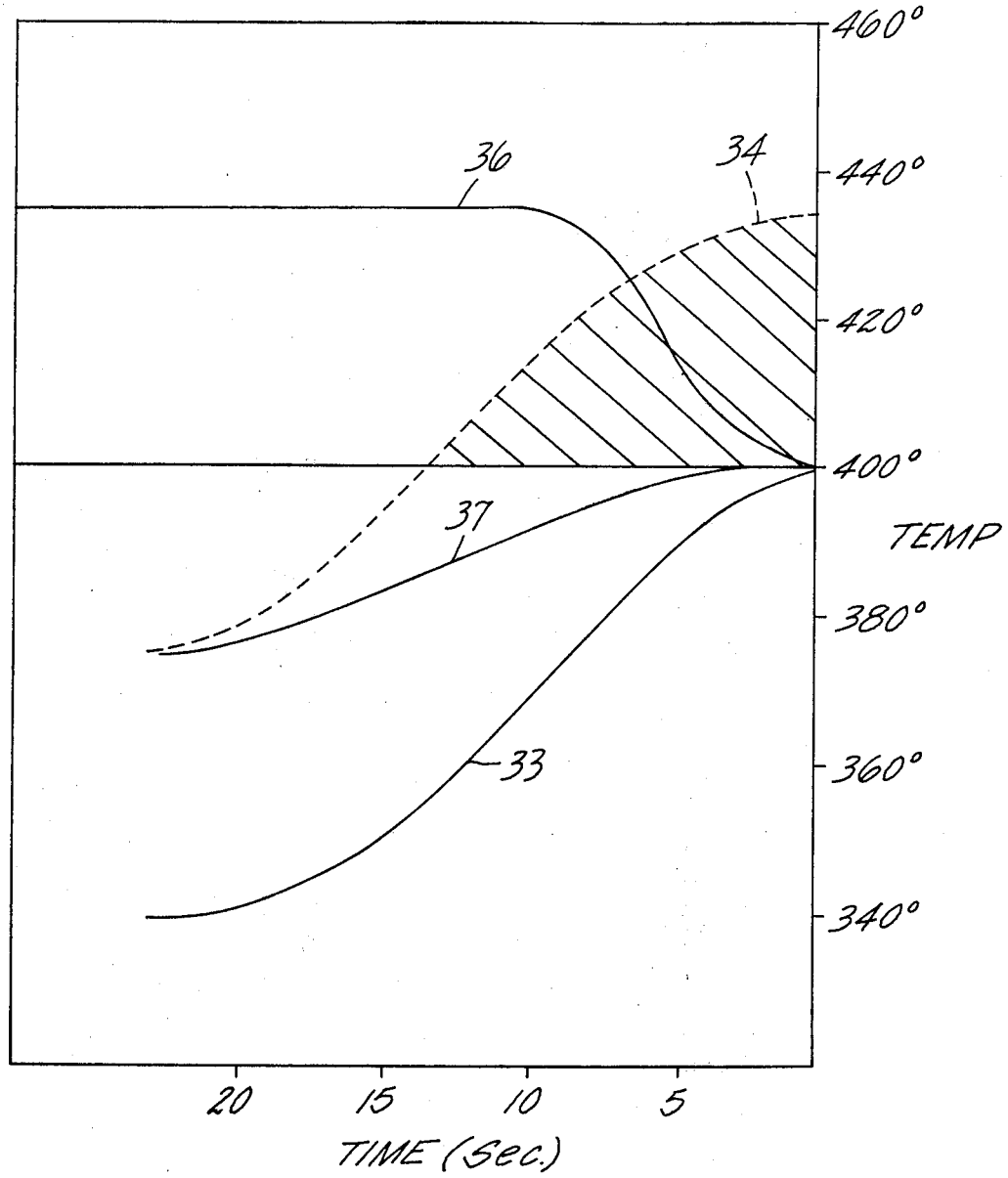
FIG. 4 is a chart showing the temperature response of a device utilizing the subject invention.

It is observed from curve 37 of FIG. 4 that the glue is not overheated, while a substantial improvement in efficiency is obtained through the use of the combined control circuits. Depending on the glue and the circuit parameters, various degrees of compensation can be accomplished.

We claim:

1. In a hot melt material dispensing appliance having means to intermittently feed a rod of material through a heated melt body having a material retaining chamber constructed therein in order to cause a flow of hot fluid material therefrom, a system to control the temperature of the material comprising:

A. a first control circuit connected to regulate the energization of the melt body heaters in response to the temperature of the melt body to provide heat sufficent to raise the material in the chamber to a predetermined temperature; and B. a second control circuit connected to increase the temperature at which the melt body heaters are regulated during the introduction of fresh material to the chamber in order to compensate for the drop in output material temperature caused thereby.

2. In a hot melt material dispensing appliance having means to intermittently feed a rod of material through a heated melt body having a material retaining chamber constructed therein in order to cause a flow of hot fluid material therefrom, a system to control the temperature of the material as described in claim 1 wherein the first control circuit comprises:

A. means to sense the temperature of the melt body;

B. means to adjustably set a predetermined temperature standard;

C. means to compare the sensed melt body temperature with the predetermined adjusted temperature, and to generate a signal until said temperatures are equal; and D. a switch connected to energize the heaters in response to signals from the comparison means and to deenergize the heaters in the absence of said signals.

3. In a hot melt material dispensing appliance having means to intermittently feed a rod of material through a heated melt body having a material retaining chamber constructed therein in order to cause a flow of hot fluid material therefrom, a system to control the temperature of the material as described in claim 1 wherein the second control circuit comprises:

A. compensating means connected to increase the predetermined temperature standard; and B. a switch connected to energize the compensating means during material feed.

4. In a hot melt material dispensing appliance having means to intermittently feed a rod of material through a heated melt body having a material retaining chamber constructed therein in order to cause a flow of hot material therefrom, a system to control the temperature of the material as described in claim 1 wherein the first control circuit comprises:

A. a thermistor mounted on the melt body to sense the temperature thereof, the resistance of said thermistor varying inversely to said temperature;

B. a variable resistor connected in series with the thermistor to form a voltage divider circuit;

C. means to generate a signal when the resistance of the thermistor is greater than the resistance of the variable resistor;

D. a switch connected to energize the heaters in response to the signals and to deenergize the heaters in the absence of said signal.

5. In a hot melt material dispensing appliance having means to intermittently feed a rod of material through a heated melt body having a material retaining chamber constructed therein in order to cause a flow of hot fluid material therefrom, a system to control the temperature of the material as described in claim 4 wherein the signal generating means comprises an integrated circuit having an internal reference voltage which is compared to the voltage drop across the thermistor, said integrated circuit being connected to generate a signal when the voltage drop across the thermistor is greater than the internal reference voltage.

6. In a hot melt material dispensing appliance having means to intermittently feed a rod of material through a heated melt body having a material retaining chamber constructed therein in order to cause a flow of hot fluid material therefrom, a system to control the temperature of the material as described in claim 4 wherein the heater energizing switch comprises an electronic gate which is connected to conduct current to the heaters when a signal is received from the signal generator and to disconnect the heaters in the absence of said signal.

7. In a hot melt material dispensing appliance having means to intermittently feed a rod of material through a heated melt body having a material retaining chamber constructed therein in order to cause a flow of hot fluid material therefrom, a system to control the temperature of the material as described in claim 5 wherein the second control circuit comprises:

A. a resistor connected to the integrated circuit to cause a compensating drop in the internal reference voltage upon conduction of current; and B. a transistor connected to allow conduction of current through the compensating resistor during actuation of the material feed.

8. In a hot melt material dispensing appliance having means to intermittently feed a rod of material through a heated melt body having a material retaining chamber constructed therein in order to cause a flow of hot fluid material therefrom, a system to control the temperature of the material comprising:

A. a thermistor mounted on the melt body to sense the temperature thereof; the resistance of said thermistor varying inversely to said temperature;

B. a variable resistor connected in series with the thermistor to form a voltage divider circuit;

C. an integrated circuit having an internal reference voltage which is compared to the voltage drop across the thermistor, said integrated circuit being connected to generate a signal when the voltage drop across the thermistor is greater than said internal reference voltage;

D. a resistor connected to the integrated circuit to cause a compensating drop in the internal reference voltage upon conduction of current; and E. a transistor connected to allow conduction of current through the compensating resistor upon actuation of the material feed.

* * * * *

UNITED STATES PATENT OFFICE

CERTIFICATE OF CORRECTION

Patent No. 4,059,204 Dated November 22, 1977

Inventor(s) Robert J. Duncan et al

It is certified that error appears in the above-identified patent and that said Letters Patent are hereby corrected as shown below:

Cl. 4, Column 5, Line 25, after the word "hot" - insert - the word "fluid"

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*